US005363285A

United States Patent [19]

Wideman

[11] Patent Number: 5,363,285

[45] Date of Patent: Nov. 8, 1994

[54] SIDE HANDLED BATON AND FLASHLIGHT ASSEMBLY

[76] Inventor: R. Leon Wideman, 1650 Neff Rd., St. Clair, Mo. 63077

[21] Appl. No.: 167,786

[22] Filed: Dec. 15, 1993

[51] Int. Cl.[5] ..... A63B 15/02

[52] U.S. Cl. ..... 362/102; 362/399; 273/84 R

[58] Field of Search ..... 362/102, 109, 190, 253, 362/399; 273/84 R

[56] References Cited

U.S. PATENT DOCUMENTS

| | | | |
|---|---|---|---|
| 786,040 | 3/1905 | Liberman et al. | 362/102 |
| 2,260,639 | 10/1941 | Powell | 362/102 |
| 3,710,092 | 1/1973 | Olbermann, Jr. | 362/205 |
| 3,737,649 | 6/1973 | Nelson et al. | 362/102 |
| 4,479,171 | 10/1984 | Mains | 362/102 |
| 4,819,137 | 4/1989 | Hamilton | 362/102 |
| 4,964,636 | 10/1990 | Ashihara | 273/84 |
| 5,016,148 | 5/1991 | Kohm | 362/102 |
| 5,060,123 | 10/1991 | Arnold | 362/102 |
| 5,079,679 | 1/1992 | Chin-Fa | 362/102 |
| 5,086,377 | 2/1992 | Roberts | 362/102 |
| 5,142,464 | 8/1992 | Wang | 362/295 |
| 5,197,796 | 3/1993 | Moore | 362/202 |
| 5,287,255 | 2/1994 | Strodtman | 273/84 R |

*Primary Examiner*—Stephen F. Husar
*Attorney, Agent, or Firm*—Polster, Lieder, Woodruff & Lucchesi

[57] ABSTRACT

A side handle baton and flashlight assembly as well as a kit for converting a conventional flashlight into a side handle baton and flashlight assembly. A conventional flashlight having an elongated handle section adapted to hold a plurality of dry cell batteries is separated from a conventional lamp section having a bulb assembly therein. An electrical contact assembly is provided for installation in an end of the handle section. A spacer is provided to connect the handle section to the lamp section. The spacer has an elongated tubular body with a electrically conductive insert therein. The insert has a first electrical contact at one end and a second electrical contact at the other end. A pair of conductive wires extend from the first contact to the second contact. The first electrical contact in the insert is in contact with the lightbulb assembly and the second electrical contact in the insert is in contact with the contact assembly in handle section. A side handle is provided for attachment the spacer, perpendicular to the handle. A selection of interchangeable tips are provided to attach to the striking end of the handle section.

8 Claims, 3 Drawing Sheets

SIDE HANDLED BATON AND FLASHLIGHT ASSEMBLY

BACKGROUND OF THE INVENTION

This invention relates generally to a personal protective device, more particularly to combination side handle baton and flashlight assembly as well as a kit for converting a conventional flashlight to a side handled baton and flashlight.

Heavy duty flashlights that function as a baton or club and carried by a police officer or watchman are known to the art. A law enforcement officer can use the flashlight as an offensive weapon to strike or subdue a dangerous individual. Furthermore, the device can function as a conventional flashlight and is, therefore, more versatile than a simple baton. The combination eliminates the need for the police officer to carry both a flashlight and a baton or nightstick.

Heretofore, flashlight/baton combinations were generally limited to an elongated metal flashlight of sufficient length to function as a baton or nightstick. However, this combination has significant limitations when used a protective device. Such devices must be held and used in a conventional manner. That is, the flashlight is held at one end, like a club, and used to strike an aggressive or dangerous person. This particular design renders the baton/flashlight more of an offensive weapon than a defensive tool. Therefore, the elongated flashlight/baton is severely limited in its defensive capabilities.

Many law enforcement officers are trained or can be trained in the martial arts. One aspect of martial arts training is to teach the police officer to use empty handed fighting techniques, as well as traditional martial arts weapons, in a defensive manner. The arresting officer can use his or her martial arts training and weapons defensively while subduing a suspect. If necessary, the officer can use offensive tactics to disable an aggressor.

One traditional martial arts weapon that can be used by a police officer for defensive as well as offensive purposes is the side handle weapon known as a tonfa or tui-fa (wooden handle). The tonfa is derived from an ancient Okinawan hand-held agricultural tool and consists of an elongated wooden shaft with a shorter side handle that extends perpendicular to the shaft. The user grasps the side handle of the tonfa and manipulates the shaft section so as to strike an opponent or block a blow. The tonfa can be rotated so that the shaft extends out to strike or, rotated about the side handle so the shaft is parallel to the user's arm to deflect blows. The tonfa has the distinct advantage over a straight club or baton in that it can be quickly manipulated between an offensive position and a defensive position. Moreover, the side handle is grasped naturally by the user and is easier to hold than the shaft of a traditional baton or nightstick. The user can maintain a better grip and is less likely to drop the weapon or be stripped of the weapon during an altercation.

It is readily apparent that combining a side handle baton or tonfa with a flashlight is both useful and desirable. U.S. Pat. No. 4,479,171, to Mains, provides a side arm baton and flashlight combination. However, prior art batons have notable deficiencies. For example, such a baton is manufactured or provided in a standard length. The length can not be adjusted or varied to suit the user. Furthermore, the striking end of the baton, opposite the lamp end, is blunt and functions solely as a club and does not accommodate the attachment of a pointed tip to create a debilitating offensive weapon. Moreover, most law enforcement officers are issued heavy duty flashlights. It is not cost effective, therefore, to replace the officer's flashlight with a side handle baton flashlight. It would be practical and useful to convert an existing flashlight into a side handle baton and flashlight combination.

The use of a side handle flashlight/baton combination is not limited to police officers. Individuals, such as civilians trained in the use of martial art weapons, may wish to convert a flashlight into a side handled baton and flashlight combination for personal self-defense.

SUMMARY OF THE INVENTION

It is therefore a principal object of the present invention to provide an apparatus, in the form of a conversion kit, to convert a conventional metal flashlight into an elongated, side handled baton and flashlight assembly.

Another object of the invention is to provide a side handle baton and flashlight combination that employs a spacer element with an electrically conductive insert therein, that can be inserted between the handle section and the lamp section of a conventional flashlight to increase the length of the flashlight.

Yet another object of the invention is to provide a side handle baton and flashlight combination that can accommodate various lengths of spacers and/or handles so as to adjust the length of the device.

Another object of the invention is to provide a side handle baton and flashlight combination having a side handle that can be attached to the spacer section so as to create a side handle baton and flashlight combination.

Still another object of the invention is to provide a side handle baton and flashlight combination that has interchangeable point pieces, at the striking end, so as to covert a blunt end into a pointed weapon.

Yet another object of the invention is to provide a kit to retrofit a standard flashlight and convert it into a side handle flashlight and baton combination that is economical to manufacturer, easy to assemble, and well suited for its intended purposes.

In accordance with the invention generally stated, a side handle baton and flashlight assembly as well as a kit for converting a conventional flashlight into a side handle baton and flashlight assembly is provided. A conventional flashlight, having an elongated handle section designed to hold a plurality of dry cell batteries and a lamp section, having a light bulb assembly therein, are disassembled. A electrical contact assembly is provided to install within the proximal end handle section. A spacer is provided, the spacer having an elongated, tubular is attachable between the handle section and the lamp section. The spacer has conductive insert therein. The conductive insert has an electrical contact at the proximal end and an electrical contact at the distal end. When inserted in the spacer, the electrical contact at the distal end is an electrical contact with the contact assembly installed in the handle section. The electrical contact at the proximal end is an electrical contact with the light bulb assembly within the lamp section. Electrically conductive wire extend axially within the insert between the two contacts so as to complete a circuit from the batteries to the light bulb. A side handle is provided for mounting on the spacer, perpendicular to the handle section. Interchangeable striking tips are provided for attachment to the distal end of the handle section to create a pointed weapon for striking.

DESCRIPTION OF THE PREFERRED EMBODIMENT

Figure 1:
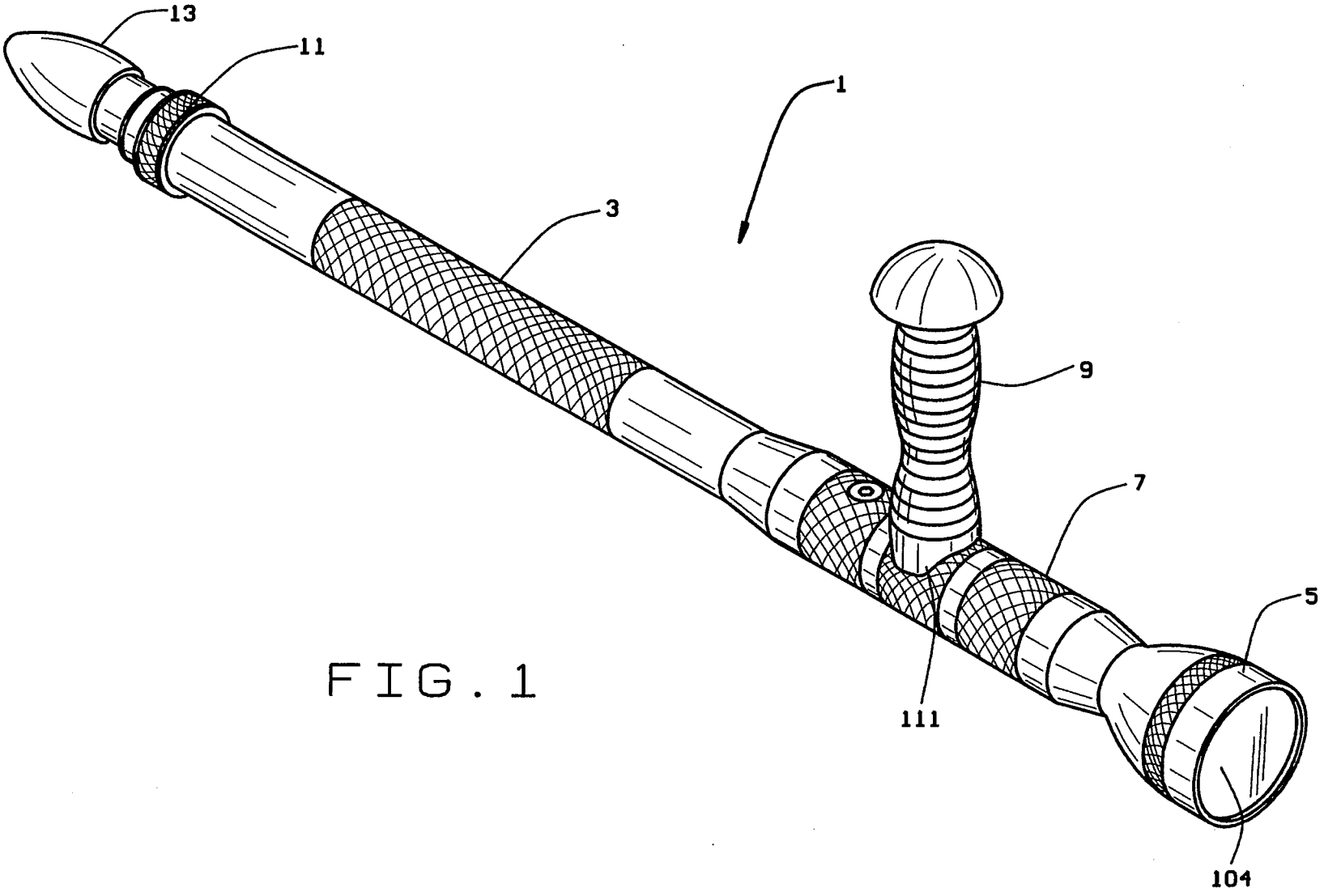
FIG. 1 is a perspective view of a side handle baton and flashlight assembly of the present invention.

A side handle baton and flashlight assembly constructed in accordance with the principles of the present invention is indicated generally by reference numeral 1 in FIG. 1. Baton 1 has an elongated handle 3, a conventional lamp 5, and a spacer section 7 between the handle 3 and lamp 5. A side handle 9 is attached to spacer 7 and extends perpendicular to handle 3. A threaded joiner 11 is connected to the distal end of handle 3 and an interchangeable weapon tip 13 is attached to handle 3 by joiner 11. The elements of baton 1 will be described in greater detail hereinafter.

Handle 3 and lamp 5 are components of a commercially available, metallic heavy flashlight such as a Maglite® (MAG INSTRUMENT, Ontario, Calif.) or other similar flashlight 3. Handle 3 and lamp 5 are disassembled and the various elements, as will be described below, can be provided in a kit to assemble side handle baton and flashlight 1.

Figures 2, 2A:
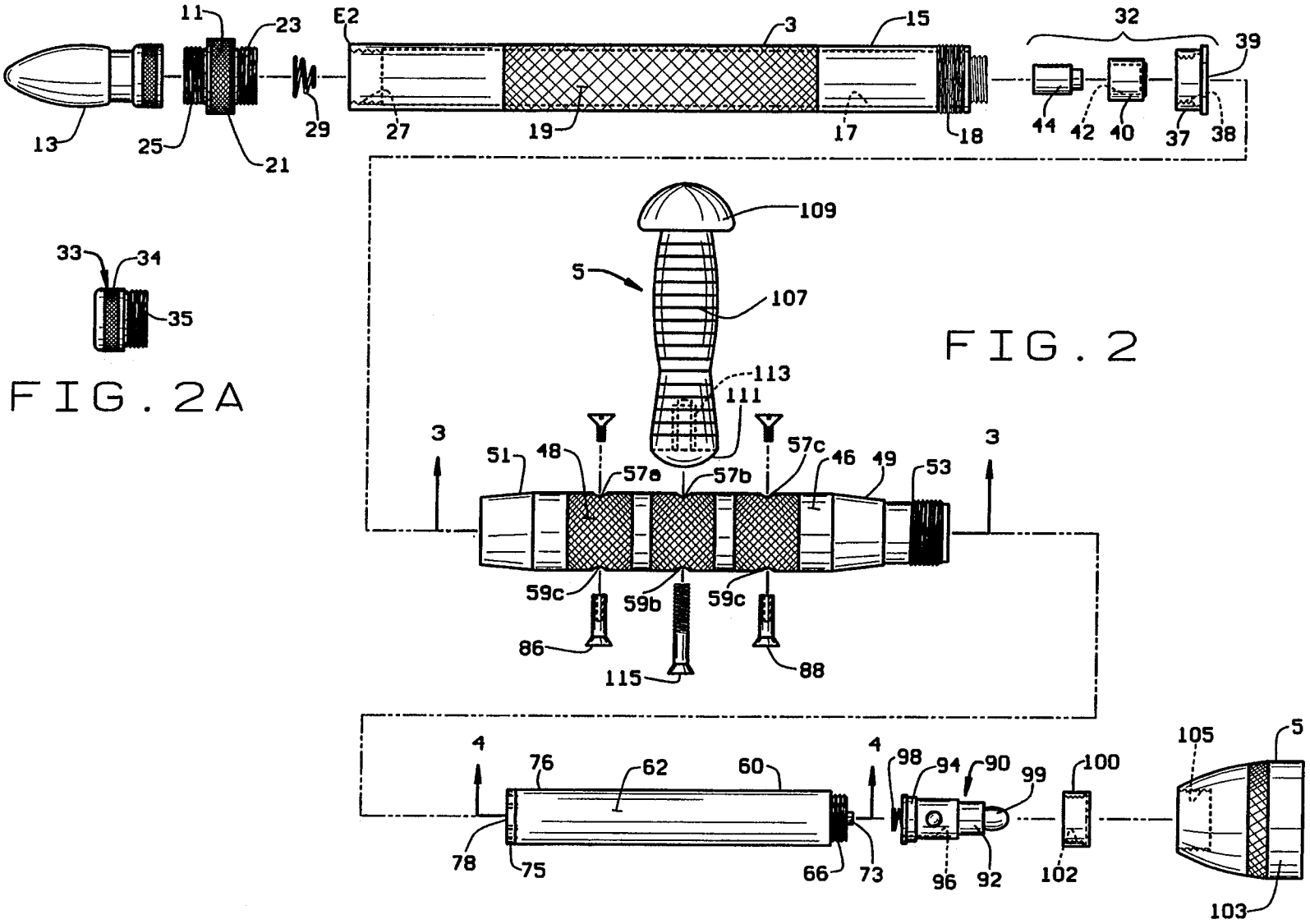
FIG. 2 is an exploded view of the side handle baton and flashlight assembly as shown in FIG. 1.
FIG. 2A is a side elevational view of a conventional end cap for a side handle baton and flashlight assembly of the present invention.

The elements of baton 1 are illustrated in greater detail in FIG. 2. Handle 3 is a conventional elongated tubular metallic flashlight handle having an outer wall 15 defining longitual bore 17. Wall 15 has external knurling 15 to improve the user's grip. Wall 15 has external threaded section 18 at the proximal end E1 and internal threads (not shown) therein. Bore 17 is designed to hold a plurality of dry cell batteries (not shown) for example 6 (six) D cell battery arranged in series within bore 17. Joiner 11 has a body portion 21 and opposed threaded extensions 23 and 25. Threaded extension 23 engages threaded counterbore 27 in the distal end E2 of handle section 3. A bias spring 29 or other appropriate biasing means is situated between joiner 11 and batteries (not shown) housed within bore 17 to urge the batteries towards the proximal end E1 of handle 3. An interchangeable tip 13 formed of milled aluminium or other appropriate material, can be screwed on to threaded extension 25. Tip 13 can be provided with an externally threaded end to directly attach to threaded bore 27 without joiner 11. Various configurations of tip 13 can be provided to create a weapon with a blunt end or a deadly point. It should also be noted that a conventional threaded end cap 33, as shown in FIG. 2A, can be attached to directly to threaded bore 27 or to joiner extension 25. Conventional cap 33 has a body section 34 and a threaded extension 35 which engages threaded counterbore 27 to form a blunt striking tip. Furthermore, additional handles 3 can be attached, end-to-end, to form a longer device by screwing threaded section 18 into a threaded counter bore 27.

Electrical contact assembly shown generally at 32, is installed within the proximal end E1 of handle 3. Assembly 32 has a brass retainer collar 36 with external threaded 38 thereon to engage internal threads (not shown) in proximal end E1 of handle 3. Collar 36 has an internal bore 39. An insulating spacer 40, having an internal bore 42, seats in bore 39. Spacer 40 can be formed from synthetic insulating material, such as delrin, or other appropriate material. A solid brass core contact 44 seats in bore 42.

Figure 3:
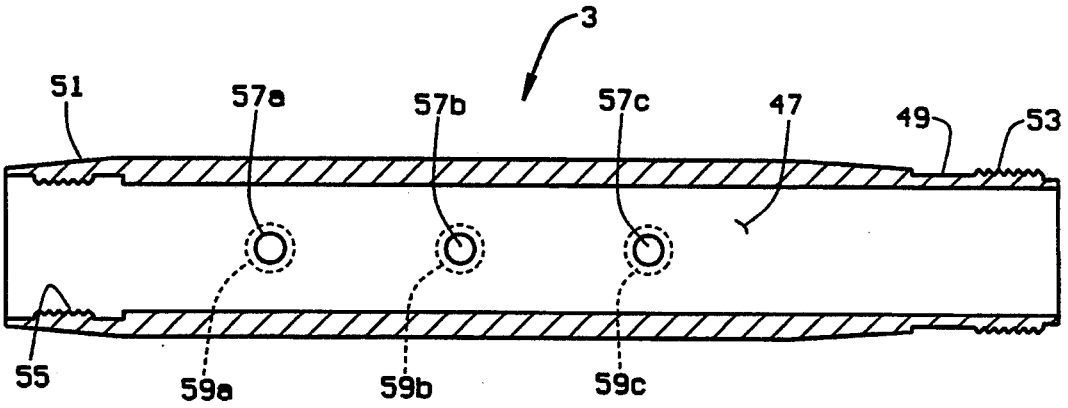
FIG. 3 is a cross sectional view of the spacer element of the side handle baton assembly of the present invention taken along lines 3—3 in FIG. 2.

Spacer 7 is shown in greater detail in FIGS. 2 and 3. Spacer 7 has a generally elongated tubular wall 46 which defines longitudal bore 47. Wall 47 has external knurling 48. Spacer 3 is formed from milled aluminium or other appropriate durable, lightweight material. Wall 47 has a tapered first or proximal end 49 and a tapered second or distal end 51. End 49 has threaded extension 53 formed thereon. End 51 has a threaded, internal counterbore 55 to accept threaded section 18 of handle 3. A plurality of holes **57*a*, 57*b* and 57*c* are formed in one side of wall 47 and corresponding taper-bored holes 59*a*, 59*b* and 59*c* aligned across from holes 57*a*–57*c* are formed in the opposite side of wall 47** to accommodate the insertion of screws as will be described below.

Figure 4:
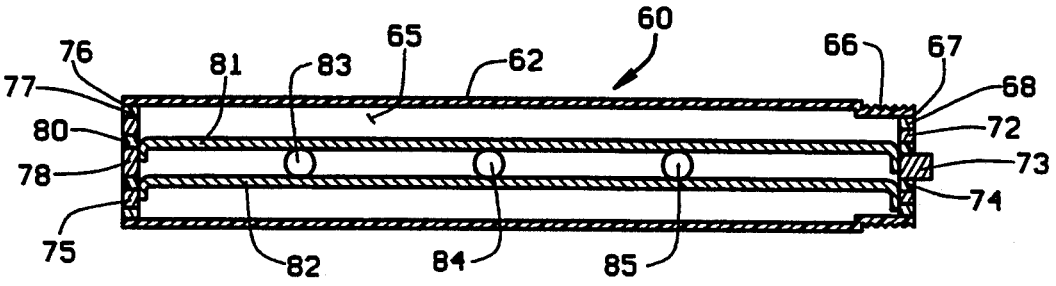
FIG. 4 is a cross sectional view of the conductive insert taken along lines 4—4 of FIG. 2.

Conductive insert 60 is sized to fit within bore 47 of spacer 3. As shown in FIG. 4, insert 60 has elongated, tubular wall 62 defining an internal axial bore 65. Insert 60 is constructed from a non-conductive, synthetic material such as delrin. A first or proximal end of wall 62 has an integral, concentric, externally threaded section 66. Annular disc 68, formed from a non-conductive material, is inserted into section 66 held by a tight friction fit. An annular brass ring 72 is seated in an annular cutout (not shown) in disc 68. A brass contact 73 is inserted centrally in bore (not shown) in disc 68. There is a non-conductive portion 74 of disc 76 between ring 72 and spacer 73.

At the distal end of insert 60, a brass ring 75 is mounted in an insulating disc 77 formed from delrin or other appropriate material. Disc 77 is inserted in a second or distal end 76 of bore 65 and held in place by a tight friction fit. An annular brass plug 78 is mounted centrally in disc 77, and functions as a positive contact. There is an insulating portion 80, of disc 77 between ring 75 and plug 78. A first conductive wire 81 extends from plug 78 to contact 74 a second conductive wire 82 extends from ring 75 to ring 72.

Insert 60 has a plurality of holes 83, 84 and 85 formed through both sides of wall 62. A pair of socket head cap screw assemblies 86 and 87 extend through holes **57*a*, 57*c*, 59*a* and 59*c* of spacer 3 and as well as holes 82 and 84 in inserts 60 to secure insert 60 in place. Although insert 60 is shown as tubular for clarity of illustration, it can instead be a solid rod with wires 81 and 82** cast in place. Other constructions could of course be used as well.

A lightbulb assembly 90 is adjacent the proximal end of insert 60. Bulb assembly 90 has a socket 92, conductive base 94, internal negative lead 96, a copper contact 98, and a conventional bulb 99. An insulating retaining collar 100 formed from delrin or other appropriate material, having internal threaded bore 102, slips over a assembly 90 and threadedly engages external thread 66 on insert 60, pinning base 94 (and internal lead 96) against ring 72. Contact 98 is biased against contact 73. A conventional lamp 5, having a frusto-conical housing 103, with lens 104 (FIG. 1), at one end and an internal threaded opening 105 at the other end, engages threads 53 on the proximal end of spacer 3 to completely cover bulb assembly 90.

Side handle 9 is attached to spacer 3. Side handle 9 has a generally elongated handle section 107 with a knob 109 formed on one end thereof. A second end 111 has a concave profile (FIG. 1) so as to rest flush against spacer 3. A threaded hole 113 is counterbored into end 111. A screw 115 is inserted through hole 59*b* in a spacer 3 and hole 84 in insert 60 and engages hole 113 and securely attach handle 5 to spacer 3. Side handle 9 is perpendicular to spacer 3. It should be noted that side handle 9 can be attached at hole 59*a*, 59*b*, or 59*c* to appropriately balance the baton.

It can be seen from the foregoing illustration that various modifications and changes can be made in the side handle baton and flashlight assembly of the present invention without departing from the scope of the invention. For example, various interchangeable tips, as at 13, can be attached to the distal end of handle 3. A overall length of spacer 3 and conductive insert 60 can be varied so as to produce a longer or shorter baton. Therefore, the foregoing description of the preferred embodiment and the accompany illustration should be viewed as illustrative only and should not be construed in a limiting sense.

I claim:

1. A kit for converting a conventional flashlight into a side handle baton and flashlight combination, the flashlight having a handle adapted to house a plurality of dry cell batteries therein and a lamp section adapted to house a light bulb attached to an end of the handle, the kit comprising:

an electrically conductive contact assembly for insertion in a first end of the handle;

an elongated, tubular spacer for attachment between the handle section and the lamp section, said spacer having an electrically conductive insert therein extending from the batteries to the lightbulb and;

a side handle attachable perpendicular to said spacer.

2. A kit for converting a conventional flashlight into a side handle baton and flashlight combination, the flashlight having an elongated handle section adapted to house a plurality of dry cell batteries and a lamp section adapted to contain a light bulb assembly, comprising:

an electrical contact assembly means insertable within an end of the elongated handle section;

a spacer attachable between the elongated handle section and the lamp section of the flashlight;

an electrically conductive insert within said spacer, said insert having a tubular casing, electrically conductive means extending from a first contact in a first end of said insert to a second contact in a second end of said insert, said first contact disposed to be in electrical contact with said electrical contact assembly in the handle and said second contact disposed to be in electrical contact with a light bulb assembly within the lamp section; and a side handle for attaching to said spacer means, perpendicular to said handle, to form a side handle baton and flashlight combination.

3. The conversion kit of claim 2 comprising a set of interchangeable tips for attaching to a second end of the elongated handle section.

4. The conversion kit of claim 2 comprising a set of interchangeable extensions for attachment to a second end of the handle section, thereby selectively increasing the length of the baton and flashlight combination.

5. A combination side handle baton and flashlight comprising:

an elongated, hollow handle section adapted to hold a plurality of dry cell batteries therein, an electrical contact assembly in a first end of said handle section;

a spacer, a first end of said spacer means being attached to said handle section;

an electrically conductive insert within said spacer, said insert having means extending from a first contact in a first end of said insert to a second contact in a second end of said insert for providing electrical connection between said first and second contacts, said first contact being in electrical contact with said contact assembly in said handle section;

a lamp section having a bulb assembly therein, said lamp section being attached to a second end of said spacer means, said bulb being in contact with said second contact in said second end of said insert;

and a side handle for attachment to said spacer, perpendicular to said spacer.

6. The baton and flashlight combination of claim 5 wherein said handle section, said spacer, and said lamp section are constructed of a durable metallic alloy.

7. The baton and flashlight combination of claim 5 further comprising a set of interchangeable tips removably attachable to a second end of said handle section.

8. The baton and flashlight combination of claim 4 wherein said insert has an elongated tubular body and a pair of electrically conductive wires therein extending from said first contact to said second contact.

* * * * *